US010069255B1

(12) United States Patent
Mahmood

(10) Patent No.: US 10,069,255 B1
(45) **Date of Patent: *Sep. 4, 2018**

(54) COAXIAL CONNECTOR HAVING ACCIDENTAL MATING PREVENTION

(71) Applicant: HUBER+SUHNER AG, Herisau (CH)

(72) Inventor: Nasir Mahmood, St. Gallen (CH)

(73) Assignee: HUBER+SUHNER AG, Herisau (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/824,791

(22) Filed: Nov. 28, 2017

Related U.S. Application Data

(63) Continuation of application No. 15/203,381, filed on Jul. 6, 2016, now Pat. No. 9,831,619.

(60) Provisional application No. 62/231,541, filed on Jul. 8, 2015.

(51) Int. Cl.
*H01R 9/05* (2006.01)
*H01R 24/38* (2011.01)

(52) U.S. Cl.
CPC ..... *H01R 24/38* (2013.01)

(58) Field of Classification Search
CPC ..... H01R 13/64; H01R 9/05; H01R 24/38
USPC ..... 439/578, 580
See application file for complete search history.

(56) References Cited

U.S. PATENT DOCUMENTS 3,325,767 A 6/1967 Lancaster
4,307,926 A 12/1981 Smith
4,397,516 A 8/1983 Koren et al.
4,444,453 A 4/1984 Kirby et al.
4,799,902 A * 1/1989 Laudig ..... H01R 24/562 439/580
5,217,391 A * 6/1993 Fisher, Jr. ..... H01R 24/44 439/578
6,309,250 B1 10/2001 Hyzin
6,824,415 B2 11/2004 Wlos
8,246,392 B2 * 8/2012 Amidon ..... H01R 13/623 439/842
8,801,459 B2 8/2014 Mrowka
9,831,619 B2 * 11/2017 Mahmood ..... H01R 24/38
2015/0200469 A1 * 7/2015 Vaccaro ..... H01R 13/24 439/578
2017/0012393 A1 1/2017 Mahmood

FOREIGN PATENT DOCUMENTS

DE 20 2015 003 482 U1 7/2015

* cited by examiner

*Primary Examiner* — Hae Moon Hyeon
(74) *Attorney, Agent, or Firm* — Pauley Erickson & Kottis

(57) ABSTRACT

The invention is directed to a coaxial connector jack for the interconnection to a corresponding connector plug. The connector jack comprises an inner conductor extending in an axial direction and an outer conductor in the form of a slotted contact sleeve arranged coaxial with respect to the inner conductor. Furthermore the coaxial connector comprises an insulator positioning the inner conductor with respect to the outer conductor and a spacer arranged inside the insulator extending along an inner side wall of the slotted contact sleeve. The spacer extends in the axial direction at least to the same axial position as the slotted contact sleeve or exceeds it.

9 Claims, 3 Drawing Sheets

COAXIAL CONNECTOR HAVING ACCIDENTAL MATING PREVENTION

CROSS-REFERENCE TO RELATED APPLICATIONS

This application is a continuation of U.S. patent application Ser. No. 15/203,381, filed on 6 Jul. 2016, issuing as U.S. Pat. No. 9,831,619 on 28 Nov. 2017, which claims the benefit of U.S. Provisional Patent Application Ser. No. 62/231,541, filed 8 Jul. 2015. The parent application is hereby incorporated by reference herein in its entirety and is made a part hereof, including but not limited to those portions which specifically appear hereinafter.

BACKGROUND OF THE INVENTION

Field of the Invention

The present invention is directed to an improved coaxial connector with the ability to prevent damage of accidentally mated connectors, in particular for a 4.3-10 jack coaxial connector accidentally mated with a 4.1-9.5 plug connector.

Discussion of Related Art

The accidental mating of not matching connectors often causes individual connector parts to be damaged. In the case of a 4.3-10 jack coaxial connector and a 4.1-9.5 plug connector, this may particularly happen due to similar appearances to the corresponding correct connector parts. Furthermore, the plug and the coupling nut of both interfaces have the same thread size (M20×1). Hence, in case of a 4.1-9.5 plug gets inserted into a 4.3-10 jack, the 4.3-10 jack is likely get damaged at the slotted sleeve of the outer contact.

However, a modification of the connector parts is not straight forward since the mechanical and electrical performance of the interface are easily changed significantly if the connector built up is varied.

DE202015003482U1, published on the Sep. 7, 2015 by Rosenberger Hochfrequenztechnik, relates to a connector with a spring contact element for electrically contacting a mating contact element of a mating connector providing a mechanical pre-stress. Hereby, the spring contact element is arranged deflectable in a radial deflection direction during interconnection with the mating contact element. Furthermore, a protection mechanism is provided for preventing deflection of the spring contact element in a radial direction opposite to the deflection direction.

The protection mechanism is motivated due to a possible accidental mating with an unsuitable mating contact element, which may permanently damage the spring contact element in the process by deflecting the spring contact element in another direction than originally intended. The protection mechanism prohibits this deflection using a blocking or reinforcement element that is orientated radially inwards or outwards of the spring contact element. Preferably, the protection mechanism may be retracted during the interconnection with a suitable mating connector. Therefore, the protection element may feature a further pre-tension element that holds the blocking element in a deployed position, if not mated to a suitable mating connector.

The present invention provides a damage protection for accidental mating of the connectors without significantly changing the electrical and mechanical properties of the connection.

SUMMARY OF THE INVENTION

The invention is directed to a coaxial connector jack for the interconnection to a corresponding coaxial connector plug. The connector jack preferably comprises an inner conductor extending in an axial direction. An outer conductor, e.g. in the form of a slotted contact sleeve, preferably arranged coaxial with respect to the inner conductor. The inner conductor preferably positioned with respect to the outer conductor by an insulator, e.g. in the form of a bushing made from a dielectric material. The connector jack according to invention complies with the connector specifications IEC 61169-54.

The connector jack comprises a spacer which is arranged inside the contact sleeve extending along an inner side wall of the contact sleeve. The spacer is extending in the axial direction at least to the same axial position as the slotted contact sleeve. In an embodiment, the spacer may exceed an end face of the slotted contact sleeve by a certain distance, e.g. in the range of 0 mm to 1 mm. The distance may vary depending on the design of the connector. In a preferred variation, the spacer may be integrally shaped with the insulator. Alternatively or in addition, the spacer may be formed as a separate part arranged inside the slotted contact sleeve providing a stop in axial direction (mating direction of the connector plug and jack). The spacer in radial direction may be spaced a distance apart from the slotted contact sleeve to avoid unwanted influence. The spacer can be made from an elastic material and if appropriate can support the slotted contact sleeve in the radial direction. The spacer can influence the contact force between the slotted contact sleeve and an outer contact of a thereto connected connector plug. Good results can be achieved if the spacer is essentially shaped like a hollow cylinder. The spacer may comprises a multi-part and/or a slotted design.

BRIEF DESCRIPTION OF SEVERAL VIEWS OF THE DRAWINGS

The herein described invention will be more fully understood from the detailed description of the given herein below and the accompanying drawings, which should not be considered as limiting to the invention described in the appended claims.

DESCRIPTION OF PREFERRED EMBODIMENTS

The foregoing summary, as well as the following detailed description of the preferred embodiments, are better understood when read in conjunction with the appended drawings. For the purposes of illustrating the invention, an embodiment that is presently preferred, in which like numerals represent similar parts throughout the several views of the drawings, it being understood, however, that the invention is not limited to the specific methods and instrumentalities disclosed.

Figure 1:
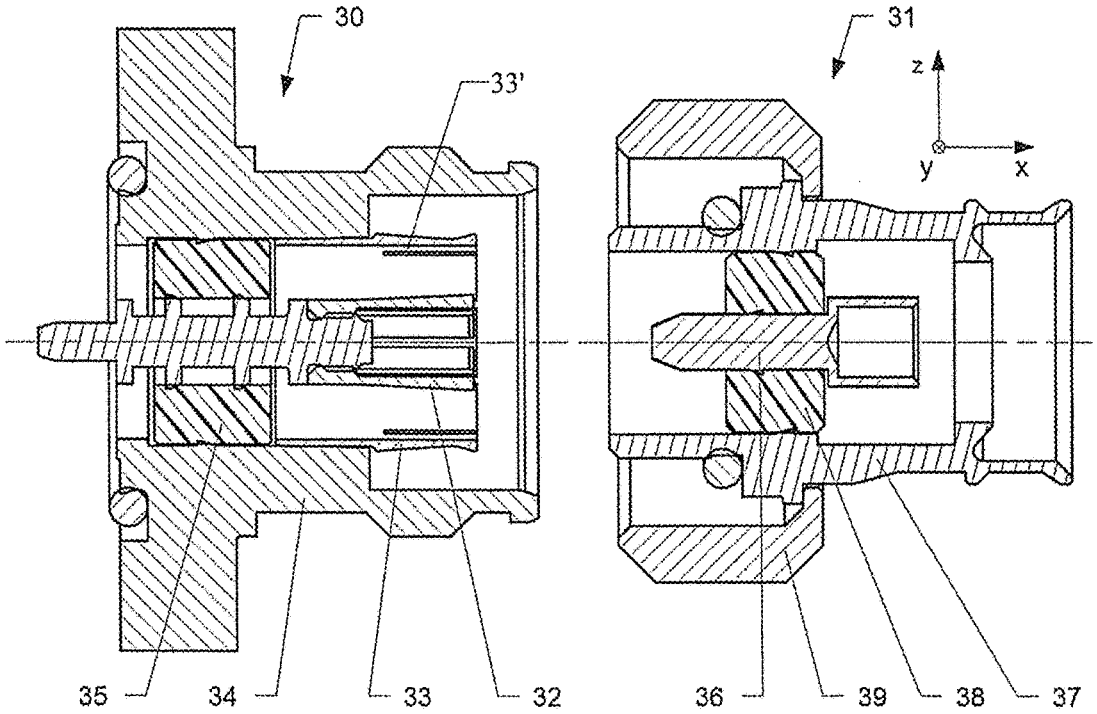
Fig. 1 (PRIOR ART)
FIG. 1 shows a conventional connector jack and an unsuitable connector plug in a sectionized side view.

FIG. 1 shows on the left hand side in a section view a conventional coaxial connector jack 30 according to the specifications IEC 61169-54 and a connector plug 31 according to the specifications IEC 60169-11 for an interconnection. The connector jack 30 comprises an inner conductor 32 and an outer conductor 33. The outer conductor 33 is interconnected to a housing 34. The outer conductor 33 comprises a slotted contact sleeve 33' which is sensitive with respect to damage from external influences as described hereinafter. As it can be seen, the inner conductor 32 is positioned with respect to the outer conductor 33 by an insulator in the form of a bushing 35 made from a dielectric material.

On the right hand side, a conventional connector plug 31 is visible in a section view. The connector plug 31 comprises an inner conductor 36 which is attached to an outer conductor (housing) 37 by an insulator 38.

The connector plug 31 comprises first connecting means 39 in the form of a coupling nut which would be in principle compatible to second connecting means 40 in the form of a corresponding outer thread arranged at the connector jack 30. However, the connector plug 31 is on the inside not compatible to the connector jack 30 and bears a great potential to cause damage to the connector jack 30 as described in accordance with FIG. 2.

Figure 2:
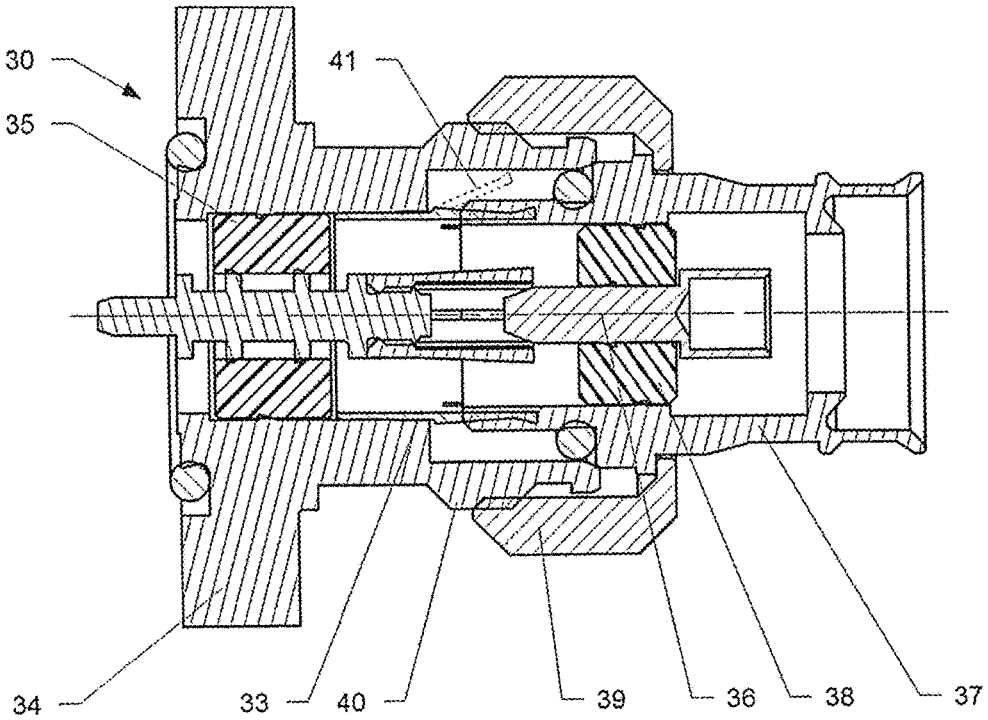
Fig. 2 (PRIOR ART)
FIG. 2 shows the a conventional connector jack and the unsuitable connector plug being accidentally mated in a sectionized view.

FIG. 2 schematically illustrates the accidentally mating of the connector jack 30 and the connector plug 31 according to FIG. 1. Meanwhile the interconnection of the housing/outer conductor (housing) 34, 37 as well as the inner conductors 32, 36 of the connector jack 30 and the connector plug 31 would be possible, the outer contact sleeve 33 of the connector jack 30 collides with the outer conductor (housing) 37 of the connector plug 31. The slotted portions of the outer contact sleeve 33 are deformed and thereby irrevocable damaged in the process of an accidental mating with the non-suitable connector plug 31 as indicated by the dotted outline 41.

Figure 3:
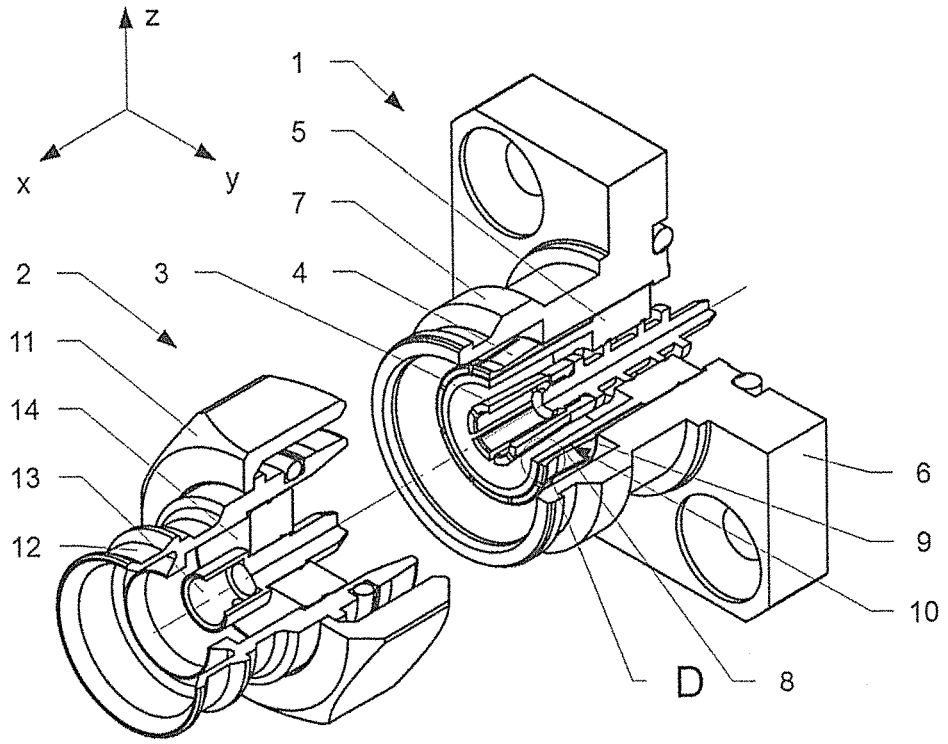
FIG. 3 shows a connector assembly comprising a connector jack and a connector plug according to an embodiment of the invention in an unmated position.
Figure 4:
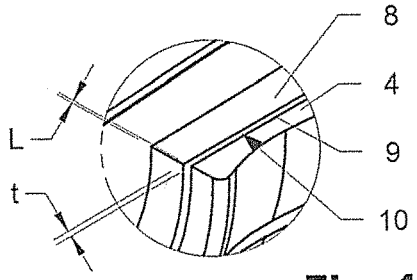
FIG. 4 detail D according to FIG. 3.

FIG. 3 shows a connector jack 1 according to an embodiment of the invention and a thereto corresponding connector plug 2 in a partially cut manner, such that the inside becomes apparent. While FIG. 3 shows the connector jack 1 and the connector plug 2 in an unmated position, FIG. 4 shows the connector jack 1 and the connector plug 2 in a mated position.

The connector jack 1 comprises an inner conductor 3 extending in an axial direction (mating direction, x-direction). A slotted contact sleeve 4 (forming part of the outer conductor) is arranged coaxial with respect to the inner conductor 3. An insulator 5 is holding (positioning) the inner conductor 3 with respect to the outer conductor 4. The slotted contact sleeve 4 and the insulator 5 are, in this embodiment, both arranged in a housing 6 which may have different designs depending on the field of application. The housing 6 forms part of the outer conductor. The outer housing 6 comprises a first connecting means 7 in the form of an outer thread 7. A spacer 8 is arranged inside the slotted contact sleeve 4 extending along an inner side wall 9 of the slotted contact sleeve 4 in the axial direction (x) forming a circumferential gap 10 between the spacer 8 and the slotted contact sleeve 4 (see FIG. 4), having a constant or variable thickness t over its extension. Even through the spacer is present, the modified connector jack 1 still complies with the specifications IEC 61169-54. The spacer 8 extends in the axial direction (x-direction) almost to the same axial position (indicated by arrow L) as the slotted contact sleeve 4 or exceeds it by a certain distance. Under certain circumstances an undersize is acceptable. Good results are normally achieved by L=−0.5 mm to 1.0 mm. In the shown variation, the spacer 8 is integrally shaped with the insulator 5. Depending on the field of application the spacer 8 can be formed as a separate part arranged afterwards inside the slotted contact sleeve 4, e.g. by a snap and/or a glue and/or a welding connection. In the shown variation, the spacer 8 is spaced in radial direction a distance apart from the slotted contact sleeve 4. The spacer 8 can be made from an elastic material and if appropriate can support the slotted contact sleeve 4 in the radial direction to influence the radial contact force when interconnected to the connector plug 2. The spacer 8 can be shaped like a hollow cylinder. If appropriate, the spacer 8 itself can be slotted or comprise several supporting elements acting in axial direction.

Figure 5:
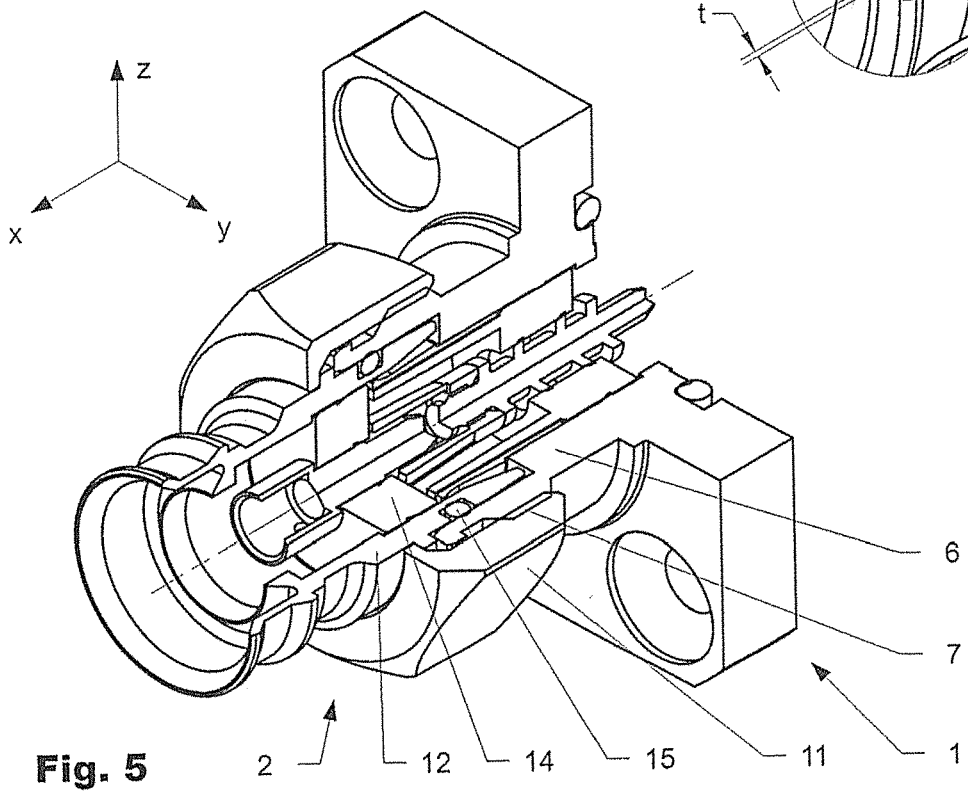
FIG. 5 the connector assembly according to FIG. 3 in a mated position.

FIG. 5 shows the connector jack 1 and the connector plug 2 in a mated position. An inner conductor 13 of the connector plug 2 is inserted into a slotted sleeve of the connector jack 1, representing the inner conductor 3. An outer conductor 12 of the connector plug 2 is inserted into the housing 6 of the connector jack 1. The slotted contact sleeve 4 of the connector jack 1 is arranged coaxial inside the housing 6 of the connector jack 1 and ensures the electrical contact to the housing, respective the outer conductor 12 of the connector plug 2. As described above, the insulator 5 is positioning the inner conductor 3 with respect to the outer conductor 4 of the connector jack 1 with the spacer 8, being integrally shaped with the insulator and arranged inside the slotted contact sleeve 4. To secure the connection, first connecting means (thread) 7 arranged at the housing 6 of the connector jack 1 and second connecting means (coupling nut) 11 are engaged to each other. Additionally a sealing 15 may be provided, positioned in a circumferential notch outside of the housing (outer conductor) 12 of the connector plug 2 and between the housing (outer conductor) 12 and the inner side of the housing 6 of the connector jack 1.

Figure 6:
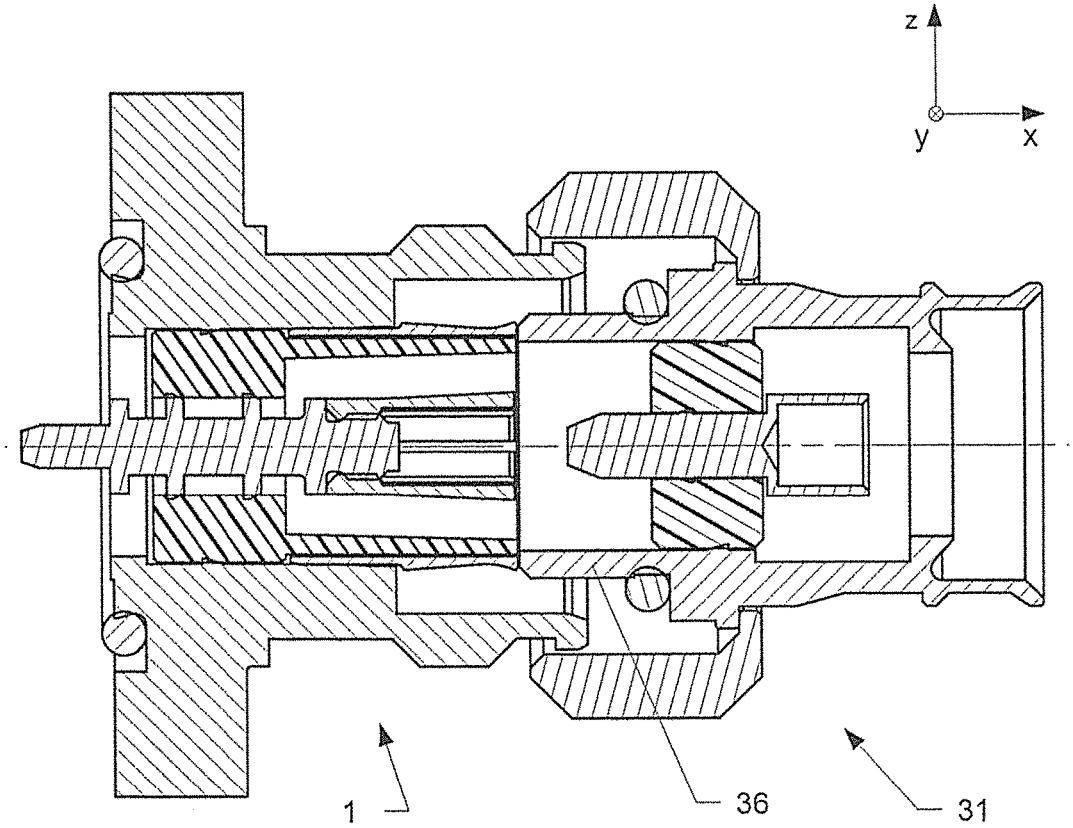
FIG. 6 a connector jack according to the invention in interaction with an unsuitable connector plug.

FIG. 6 schematically illustrates the connector jack 1 according to the invention in a perspective view, where the slotted design of the inner conductor (conductor sleeve) 3 as well as the outer contact sleeve 4 can be seen. The connector jack 1 is shown in context with an inside incompatible connector plug 31, as described in context with FIG. 1 and FIG. 2. When attempting to mate, the spacer 8 interacts due to its design in the axial direction (x) with the outer conductor 37 of the connector plug 31 thereby actively protecting the slotted contact sleeve 4 of the connector jack 1.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

It is claimed:

1. A coaxial connector jack (1) for interconnection to a corresponding connector plug (2), comprising:

a. an inner conductor (3) extending in an axial direction (x);

b. an outer conductor (4) comprising a slotted contact sleeve (4) arranged coaxial with respect to the inner conductor (3);

c. an insulator (5) positioning the inner conductor (3) with respect to the outer conductor (4); and d. a spacer (8) arranged inside the slotted contact sleeve (4) extending along an inner side wall (9) of the slotted contact sleeve (4), and e. wherein the spacer (8) extends in the axial direction at least to the same axial position as the slotted contact sleeve (4).

2. The coaxial connector jack (1) according to claim 1, wherein the spacer (8) is integrally shaped with the insulator (5).

3. The coaxial connector jack (1) according to claim 1, wherein the spacer (8) is formed as a separate part arranged inside the slotted contact sleeve (4).

4. The coaxial connector jack (1) according to claim 1, wherein the spacer (8) in radial direction is spaced a distance apart from the slotted contact sleeve (4).

5. The coaxial connector jack (1) according to claim 1, wherein the spacer (8) comprises an elastic material and supports the slotted contact sleeve (4) in the radial direction.

6. The coaxial connector jack (1) according to claim 5, wherein the spacer (8) influences the contact force between the slotted contact sleeve (4) and an outer contact of a thereto connected connector plug (2).

7. The coaxial connector jack (1) according to claim 1, wherein the spacer (8) comprises a hollow cylinder shape.

8. The coaxial connector jack (1) according to claim 7, wherein the thickness of the spacer (8) is 1-1.5 times as much as the thickness at the end of the slotted contact sleeve (4) at the maximal axial position.

9. The coaxial connector jack (1) according to claim 1, wherein the spacer (8) is slotted.

* * * * *